United States Patent [19]

Nakamura

[11] 4,247,933

[45] Jan. 27, 1981

[54] TIME STRIKING DEVICE FOR TIMEPIECE

[75] Inventor: Norihiko Nakamura, Tokyo, Japan

[73] Assignee: Rhythm Watch Company Limited, Tokyo, Japan

[21] Appl. No.: 56,468

[22] Filed: Jul. 11, 1979

[30] Foreign Application Priority Data

Jul. 20, 1978 [JP] Japan ..... 53-99976[U]
Mar. 30, 1979 [JP] Japan ..... 54-36979

[51] Int. Cl.[3] ..... G04B 21/04; G04C 21/08

[52] U.S. Cl. ..... 368/269; 368/270; 340/392

[58] Field of Search ..... 58/7, 8, 9, 12, 13, 58/38 R, 38 A; 200/38 R, 38 B, 38 C; 340/384 E, 393, 384 R, 392; 368/75, 269, 270, 271

[56] References Cited

U.S. PATENT DOCUMENTS 3,778,997 12/1973 Jauch ..... 58/13

*Primary Examiner*—Edith S. Jackmon
*Attorney, Agent, or Firm*—Koda and Androlia

[57] ABSTRACT

A time striking device for a timepiece including an electric time striking means, an electric contact means electrically controlling the operation of the time striking means, a time striking selecting cam plate synchronously rotating with a time indicating gear train to control the electric contact means in a state capable of closing circuit action at the striking time, a one-minute cam plate synchronously rotating with the time indicating gear train to control the electric contact means in a state capable of closing circuit action at one minute interval, a one-minute control lever transmitting contact point control force of the one-minute cam plate to the moving contact plates of the electric contact means.

5 Claims, 21 Drawing Figures

TIME STRIKING DEVICE FOR TIMEPIECE

BACKGROUND OF THE INVENTION

1. Field of Invention

This invention relates to a time striking device for a timepiece, and more particularly to a time striking device for a timepiece performing time striking action in an analog type timepiece with high accuracy.

2. Description of Prior Art

A time striking device for a timepiece is well-known in the art as a means for time striking or chiming at indicated times at such right-hour that a minute hand points out 0 minutes and at such half-hour that the minute hand points out 30 minutes, and it is of wide use in various clocks since the time is known without watching the time indicating hands.

In an analog type timepiece in the recent years, an electric time striking means is used in the time striking device with electronization of timepiece device. Ordinarily, this electric time striking means is driven by an electromotor to perform mechanical time striking or chiming. The operation of the above mentioned time striking means is controlled by an electric contact means, and, in order to switch it on and off, the electric time striking means has a time striking selecting cam plate in its means which rotates synchronously with a time indicating gear train of the timepiece to operate the electric contact means at the striking time. In other words, the time striking selecting cam plate is linked to a minute wheel rotated once an hour, and operates the electric time striking means at the striking time.

As mentioned in the above, the striking time is controlled by the time striking selecting cam plate which rotates in comparatively slow speed, and the prior time striking device has such drawbacks that an accurate time striking action cannot be obtained since it produces such a late striking phenomenon as the time striking action is performed after a time indicating hand passes the striking time. In particular, in the accurate analog type timepiece in the recent years using a crystal oscillator, the time striking accuracy has been strongly requested to be improved. Furthermore, it is preferable that the striking time be accurately coincided with a second indicating hand. Accordingly, the second indicating hand and the striking time are required to be correctly set each other.

SUMMARY OF THE INVENTION

Accordingly, it is a general object of the present invention to provide a time striking device for a timepiece capable of obtaining striking time with high accuracy and it is another object of the present invention to provide a time striking device for a timepiece producing no load loss in the time indicating gear train of the timepiece as well as capable of obtaining striking time with high accuracy.

In keeping with the principles of the present invention, the objects are accomplished with a time striking device for a timepiece including an electric time striking means, an electric contact means electrically controlling the operation of the time striking means, a time striking selecting cam plate synchronously rotating with the time indicating gear train to control the above mentioned electric contact means in a state capable of closing circuit action at the striking time, a time striking control cam plate synchronously rotating with the time indicating gear train to control the electric contact means in a state capable of closing circuit action at shorter interval than the time striking cam plate, and a switching control lever, one end of which is engaged with the time striking control cam plate and the other end of which is engaged with an end portion of the moving contact plate of the electric contact means, to control switching on and off action of the electric contact means. The closing circuit action of the electric contact means in the state capable of closing circuit action by the above mentioned both time striking selecting cam plate and time striking control cam plate performs the time striking operation of the electric time striking means.

In the present invention, the time striking control cam plate is composed of a one-minute cam plate which controls the electric contact means in a state capable of closing circuit action at one minute interval.

Furthermore, the present invention includes the electric time striking means, the electric contact means electrically controlling the operation of the time striking means, the time striking selecting cam plate synchronously rotating with the time indicating gear train to control the above mentioned electric contact means in a state capable of closing circuit action at the striking time, one-minute cam plate synchronously rotating with the time indicating gear train to control the above mentioned electric contact means in a state capable of closing circuit action at one minute interval, one minute control lever transmitting contact point control force of the one-minute cam plate to the moving contact plate of the electric contact means. The time striking operation of the electric time striking means is performed by the closing circuit action of the electric contact means in the state capable of closing circuit action by the above mentioned both time striking selecting cam plate and one-minute cam plate, and the one-minute control lever is taken back to the outside area of the one-minute cam rotation while it is not in the striking time so that the one-minute cam plate can run idle.

In the present invention, the one-minute control lever is controlled to move into the one-minute cam rotation area by the time striking selecting cam plate, and the controlling force of the time striking selecting cam plate is transmitted to the one-minute control lever through a rocking piece.

Accordingly, the present invention could provide the striking time with extremely high accuracy, and, in practice, the time striking accuracy less than ten seconds from the desired striking time is obtained, since the striking time is controlled by the time striking control cam plate which rotates in comparatively high speed.

BRIEF DESCRIPTION OF THE INVENTION

The above mentioned features and objects of the present invention will become more apparent by reference to the following description taken in conjunction with the accompanying drawings, wherein like reference numerals denote like elements, and in which.

Figure 19:
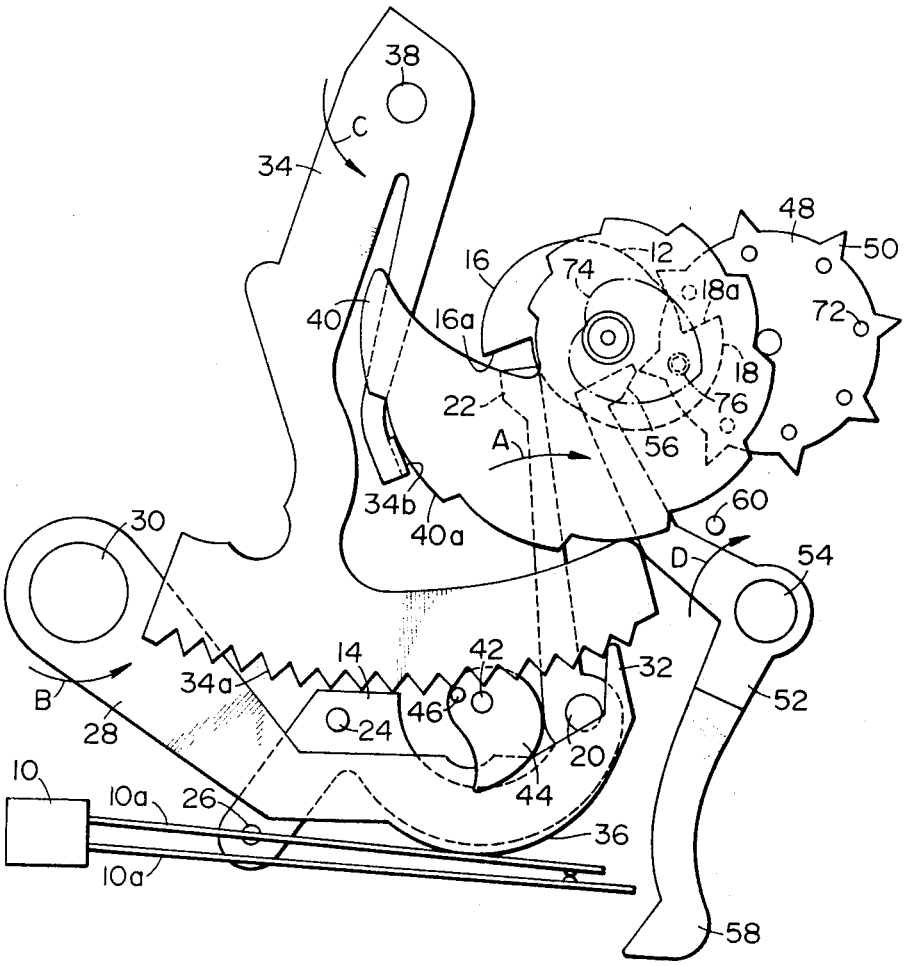
Figure 20:
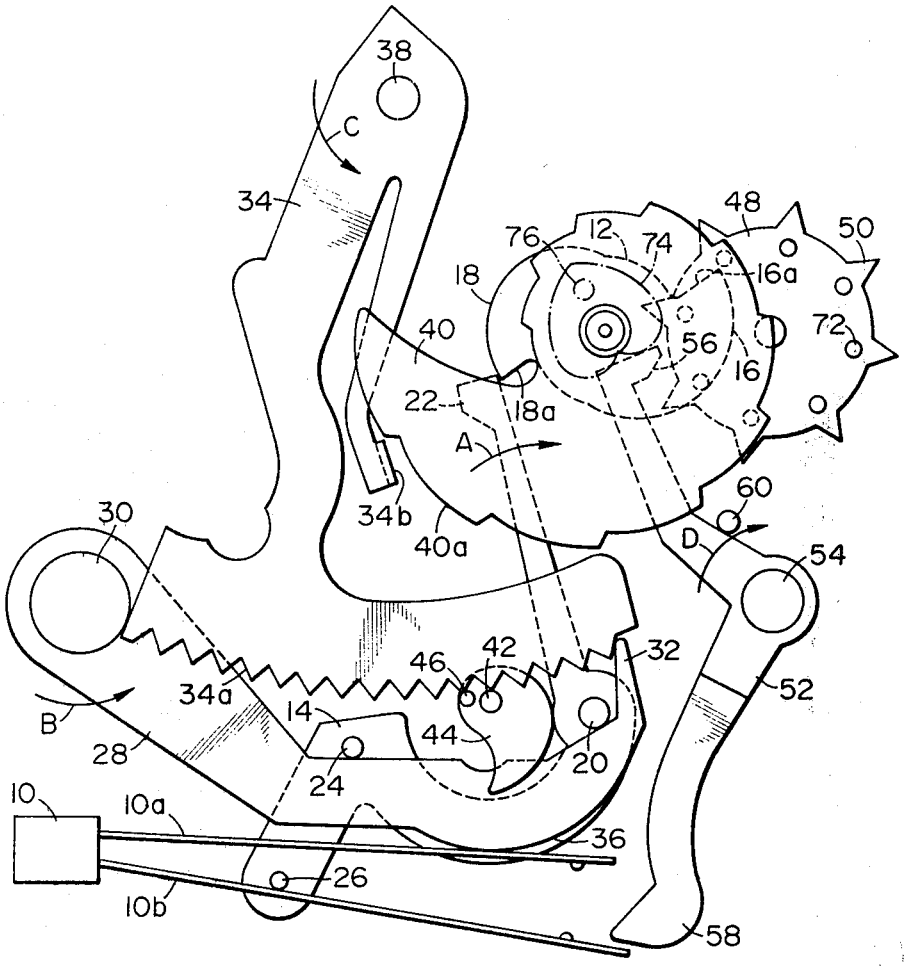
Figure 21:
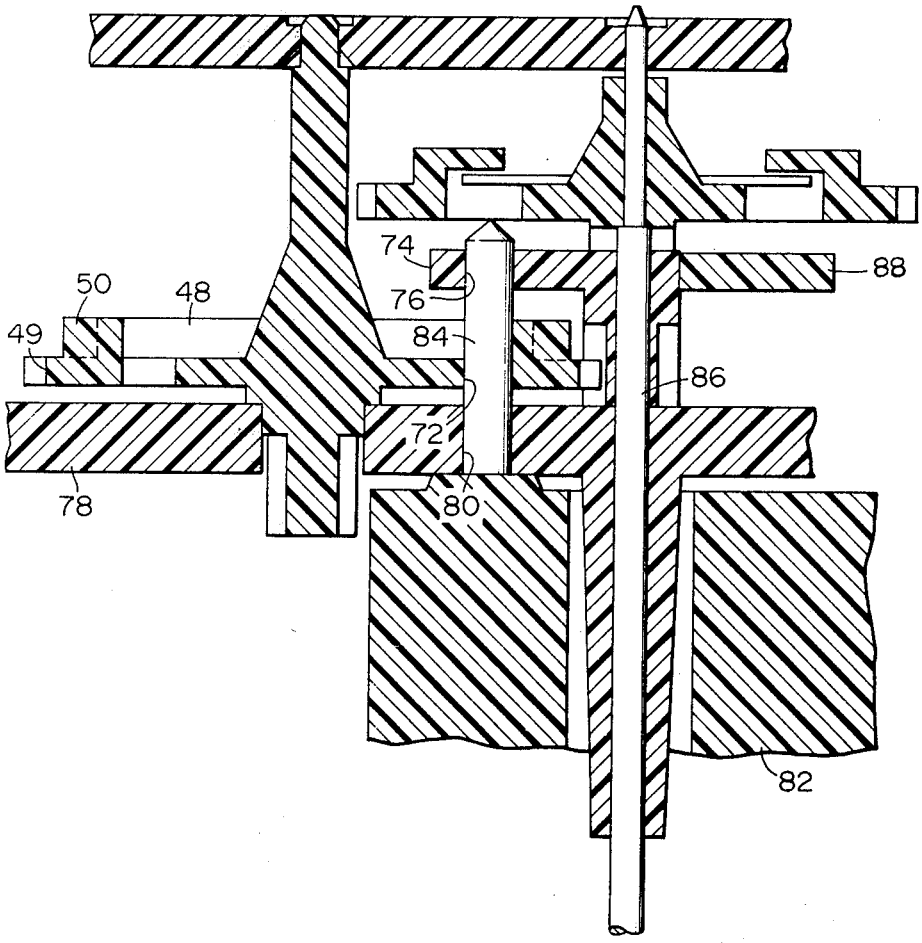

FIGS. 16, 17, 18, 19 and 20 are top views showing the respective operating conditions of the time striking device in the third preferred embodiment in accordance with the teachings of the present invention; and FIG. 21 is a sectional view in order to describe the positioning action of the time striking control cam plate and the second heart cam in the assembly of the time striking device in the third embodiment.

DETAILED DESCRIPTION OF THE INVENTION

Figure 4:
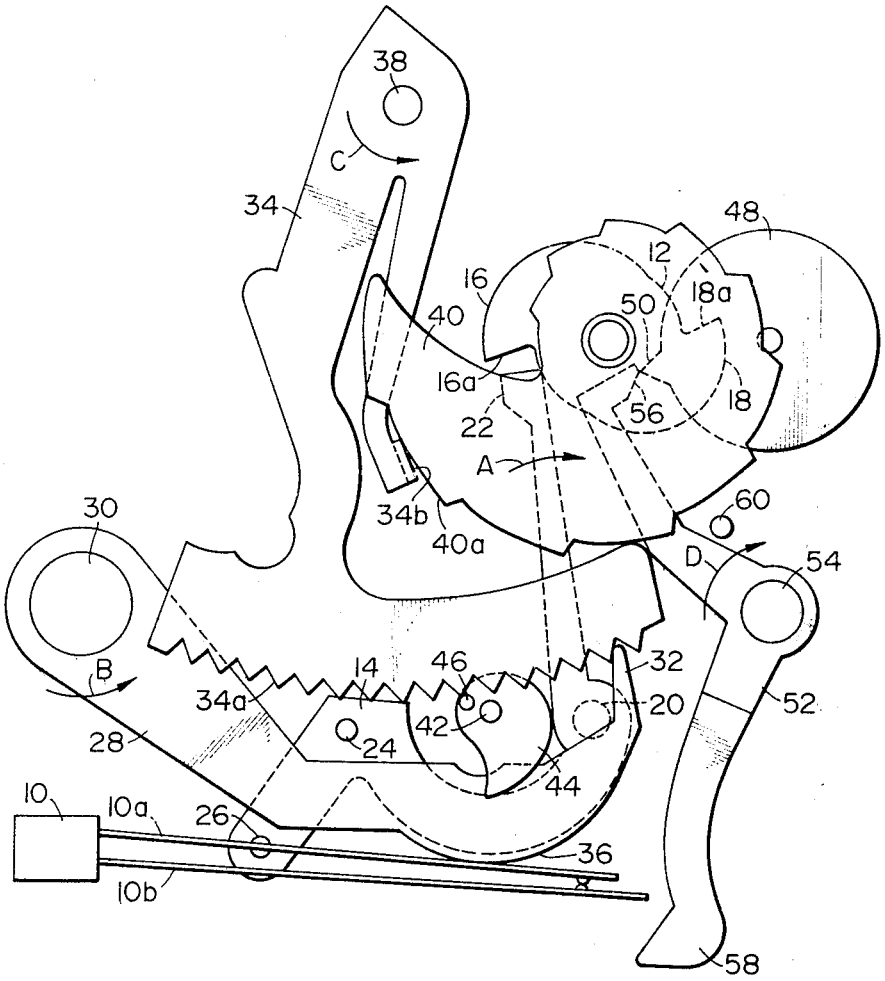
Figure 5:
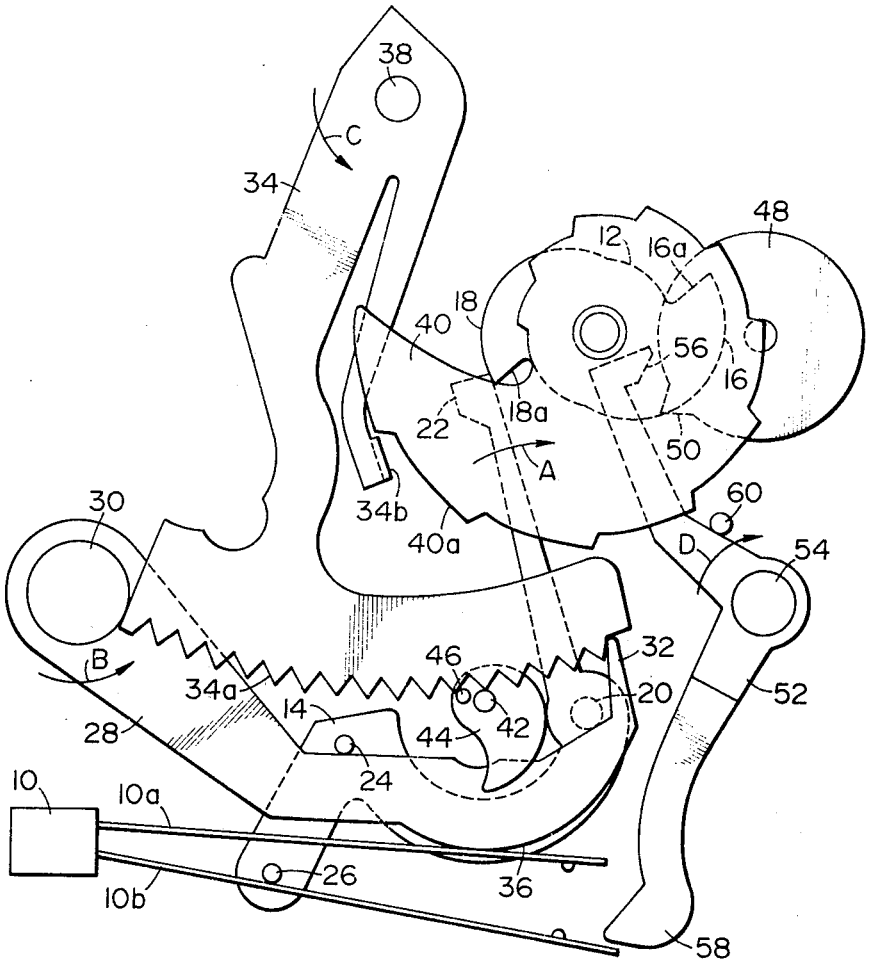
Figure 6:
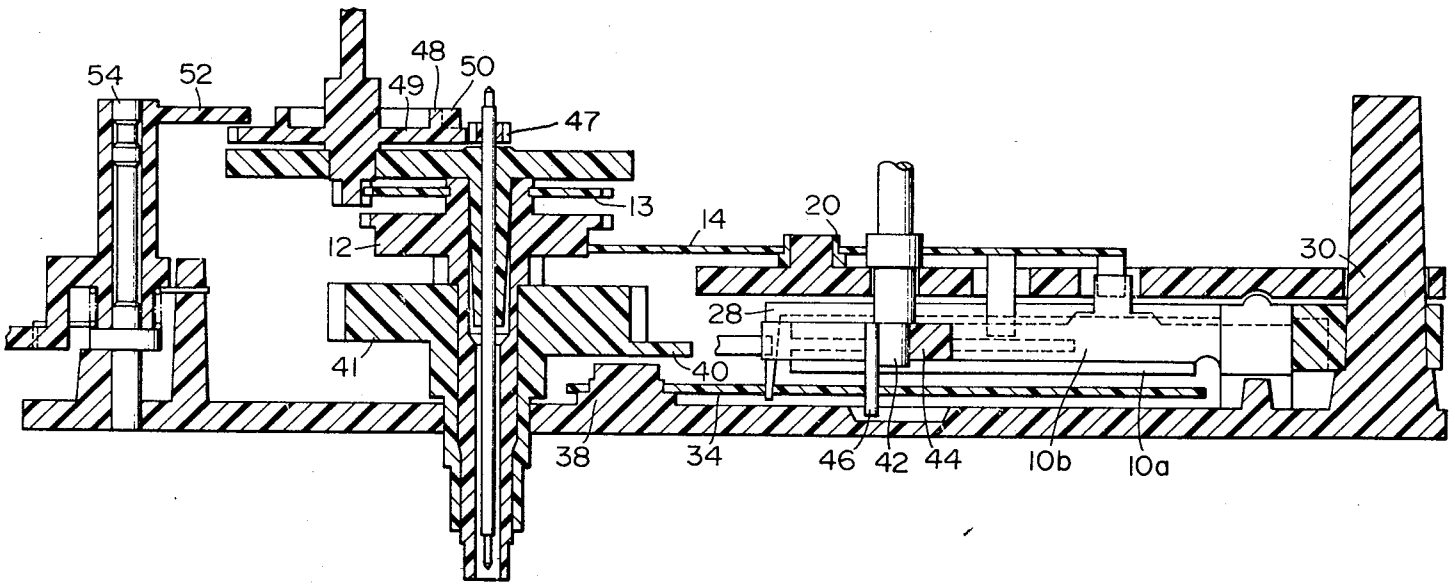
FIG. 6 is a sectional view of the time striking device in the first embodiment.

Referring more particularly to the drawings, shown in FIG. 1 through 5 are arrangement illustrations of the time striking device in the first preferred embodiment viewing the respective operating conditions from the upper direction in accordance with the teachings of the present invention, and shown in FIG. 6 is a sectional view of the time striking device in the first embodiment.

In the embodiment, an electric time striking means is consisted in a mechanical time striking means driven by an electro-motor, which is not shown in the illustrations, and an electric contact means 10 is equipped in order to electrically control the electro-motor. In the electric contact means 10 are equipped with moving contact plates 10*a* and 10*b*. In order to control the switching on and off operation of the electric contact means 10 is installed a time striking selecting cam plat 12 which synchronously rotates with a time indicating gear train, and a contact driving force of the time striking selecting cam plate 12 is transmitted to the above mentioned electric contact means 10 through a rocking piece 14. The time striking selecting cam plate 12 is fixed with a minute wheel 13 shown in FIG. 6 to the same pivot, and rotates once an hour together with the minute wheel 13. On the time striking selecting cam plate 12 are forced a cam projection 16 corresponding to a right-hour and a cam projection 18 corresponding to a half-hour at 180 degrees interval, and make it possible to start the time striking operation at the right-hour and the half-hour respectively. The leading edges 16*a* and 18*a* of the both cam projections 16 and 18 are determined and placed so that they can set the striking time, which is described later, in thirty seconds earlier than the respective right-hour or half-hour.

The rocking piece 14 is swingingly supported by a pivot 20 which is fixed to a supporting plate. A cam follower 22 formed in the one portion of the rocking piece 14 is slidingly engaged with the cam surface of the above mentioned time striking selecting cam plate 12, and the pins 24 and 26 formed in the other portions of the rocking piece 14 are engaged with a rocking lever 28 in a rocking mechanism, which is described about later, and the above mentioned moving contact plate 10*b* respectively. The rocking piece 14 is installed to be always urged toward the direction of arrow A wih elastic force so that the cam follower 22 is swingingly controlled to follow the cam surface of the time striking selecting cam plate 12, and is composed for the pins 24 and 26 to push and move the rocking lever 28 and the moving contact plate 10*b* when the cam projection 16 and 18 of the time striking selecting cam plate 12 and the cam follower 22 are engaged.

As mentioned in the above, the switching on and off operation of the electric contact means 10 is controlled at the predetermined striking time with the synchronous rotation of the time indicating gear train. In order to obtain the time striking action corresponding to the predetermined striking time the rocking mechanism is installed in the time striking device. In the illustrated embodiment, the time striking action is controlled by the number of rotation of electro-motor, and the number of time striking is established corresponding to the striking time. The rocking lever 28 is swingingly held by the pivot 30 which is fixed to the supporting plate, and a stopper 32 formed in the one end of the rocking lever 28 is elongated to be selectingly engageable with rack teeth 34*a* of a rocking gear 34. The rocking lever 28 is always urged toward the direction of arrow B with elastic force, and a circular arc shaped pressing section 36 is formed to be engageable with the moving contact plate 10*a*.

The rocking gear 34 is swingingly held by a pivot 38 which is fixed to the supporting plate and always urged toward the direction of arrow C with elastic force. The rocking gear 34 selects the number of rotation of the electro-motor or the number of time striking depending on the swung position of the rack teeth 34*a*, which is controlled by a rocking cam plate 40.

The rocking cam plate 40 is solidly molded with an hour hand wheel 41 shown in FIG. 6, and is formed with twelve step cam surface 40*a* on its outside circumference corresponding to each one hour of twelve hour display by a time indicating hand. The above mentioned rocking gear 34 has a cam follower 34*b* which is selectingly engaged with the cam surface 40*a* of rocking cam plate 40.

A driving cam 44 is fixed to a shaft 42 of a driving motor which is not illustrated, and a driving pin 46 attached to the driving cam 44 is composed to be geared with the rack teeth 34*a* of the rocking gear 34 and to release the engagement between the stopper 32 of the rocking lever 28 and the rack teeth 34*a* of the rocking gear 34 at every rotation of the electro-motor to drive and move the rack teeth 34*a* one tooth by one tooth.

As described in the above, at the predetermined striking time the time striking selecting cam plate 12 controls the electric contact means 10 in a state capable of closing circuit action through the rocking piece 14 and the time striking action is performed with the number of time striking selected through the rocking mechanism. The time striking selecting cam plate 12 rotates once an hour, and the time striking action cannot obtained with high accuracy due to the rotation in slow speed. In the present invention, however, the closing circuit action of the electric contact means 10 is controlled by a time striking control cam plate installed separately from the time striking selecting cam plate 12.

The time striking control cam plate 48 is installed with a high speed wheel in the time indicating gear train or an interlocked wheel with the high speed wheel. In the embodiment, as shown in FIG. 6, the time striking control cam plate 48 is formed by such a way that a cam projection 50 is solidly molded with a third wheel 49 which lies as a transmission wheel between a second hand wheel 47 and a minute hand wheel 13. The time striking control cam plate 48 is established to rotate six times an hour, and the above mentioned cam projection 50 is synchronously established with the 0 minute (0 second) position of the minute hand and the second hand.

In the illustrated embodiment, a cam driving force of the time striking control cam plate 48 is transmitted to the electric contact means 10 through a switching control lever 52, which is swingingly held by a pin 54 fixed to the supporting plate. An engaging portion 56 formed in the end of the switching control lever 52 is equipped to be capable of engaging with the cam projection 50, and a contact holder 58 formed in the other end is equipped to be capable of selectingly engaging with the moving control plate 10*b* of the electric contact means 10. The switching control lever 52 is always urged toward the direction of arrow D with elastic force, and elastically sustained in the position to be engaged with a pin 60 fixed to the supporting plate. The elastic sustention is required only for prevention from the shake of the switching control lever 52, and should be made in weak elastic force in order to lighten a load effection provided to the time indicating gear train in the engagement between the switching control lever 52 and the cam projection 50.

The first preferred embodiment of the present invention is composed as mentioned in the above and the operation of the first preferred embodiment is described in the following.

Figure 1:
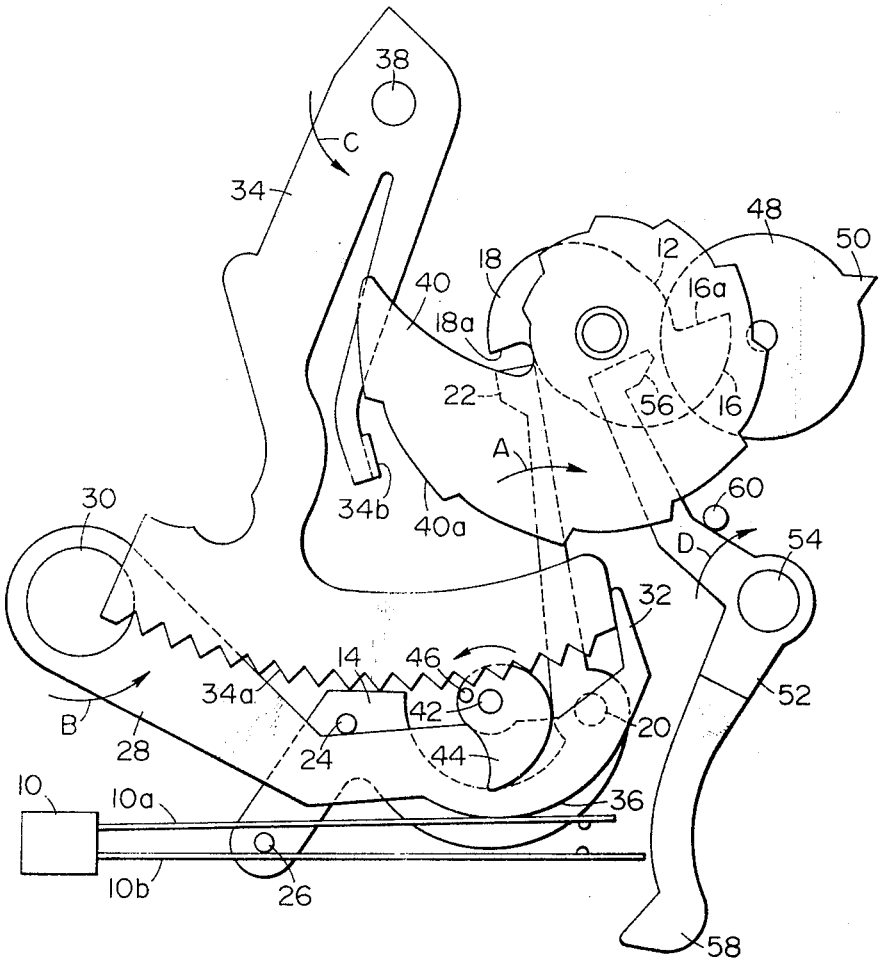
FIGS. 1, 2, 3, 4 and 5 are top views showing the respective operating conditions of a time striking device in the first preferred embodiment in accordance with the teachings of the present invention.

In FIG. 1, shown therein is a time before the striking action is performed at the right-hour and an operating state after the striking action is finished at the half-hour, for example, it corresponds to the time about 1:35. In this state, the cam follower 22 of the rocking piece 14 is engaged with the alcove portion of the time striking selecting cam plate 12, and the stopper 32 of the rocking lever 28 stays in the position to be engaged with the right end of the rack teeth 34*a* of the rocking gear 34 as illustrated. The both contact plates 10*a* and 10*b* are respectively sustained in the position by the pressing section 36 of the rocking lever 28 and the pin 26 of the rocking piece 14, and the electric contact means 10 is in the open circuit state. The time striking means is kept in non-operational state accordingly.

Figure 2:
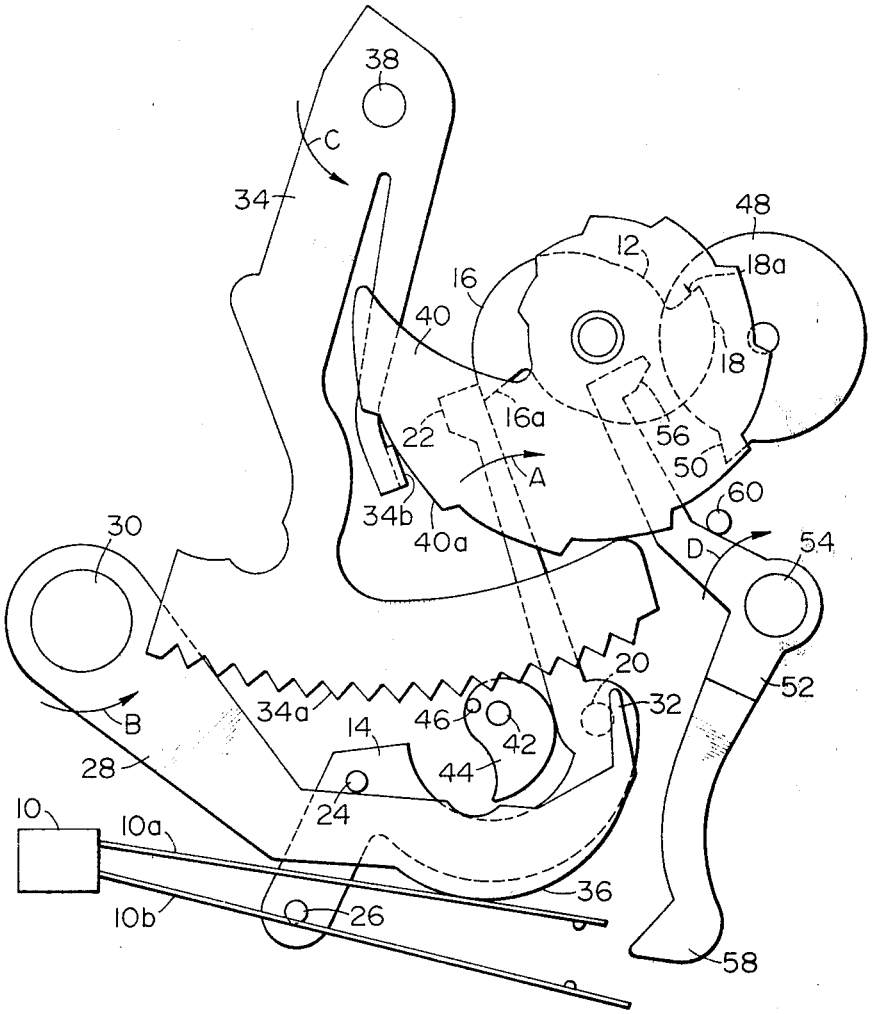

In FIG. 2, shown therein is a completed state of setting the first stage of the time striking action at the right-hour, and a state of time about 1:50 after the time striking selecting cam plate 12 rotates clockwise from the FIG. 1 conditions. In this state, the rocking piece 14 is rotated counter-clockwise by the cam projection 16 of the time striking selecting cam plate 12, and the rocking lever 28 is rotated clockwise to move to the position where the stopper 32 can be released from the rocking gear 34. Consequently, the rocking gear 34 rotates counter-clockwise to the position where the concerned surface 34*b* makes contact with the cam surface 40*a* of the rocking cam plate 40 corresponding to 2 o'clock. In this state, the both moving contact plates 10*a* and 10*b* are respectively pressed to move to the illustrated position by the pressing section 36 of the rocking lever 28 and the pin 26 of the rocking piece 14, and the electric contact means 10 is still kept in the open circuit state.

Figure 3:
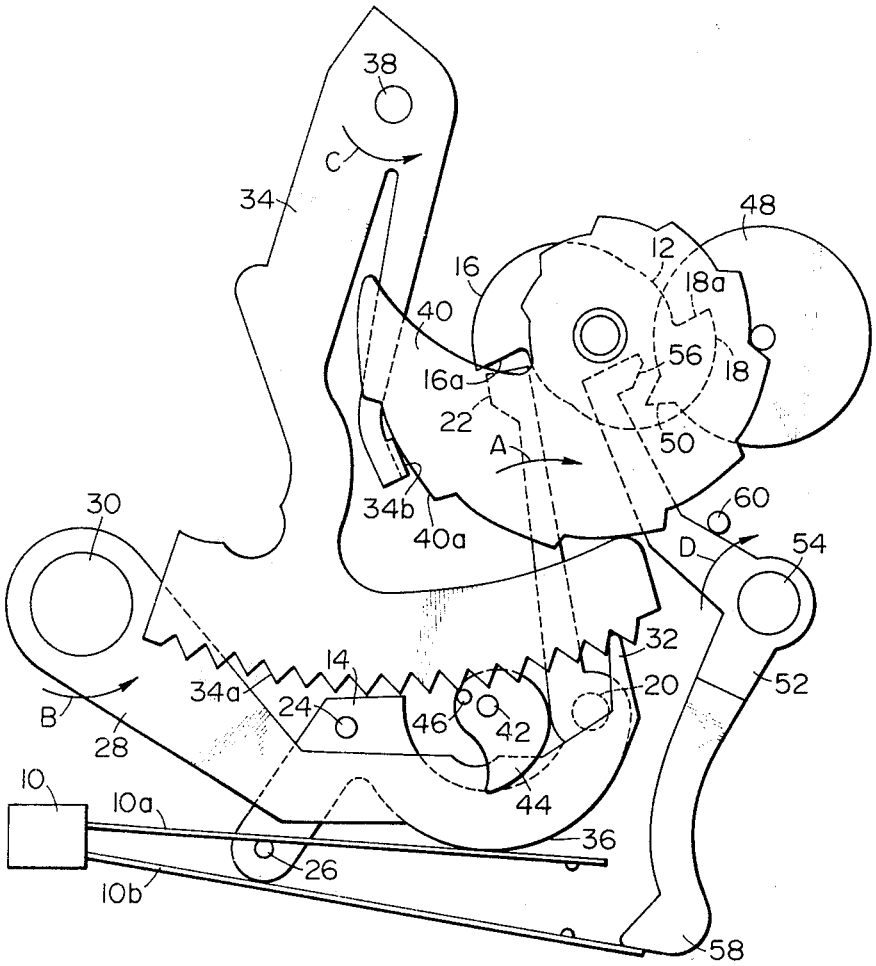

Referring to FIG. 3, shown therein is a completed state of setting the second stage of the time striking action at the right-hour, which corresponds to the time of 1:59:30. In this state, the cam follower 22 of the rocking piece 14 moves to fall into the leading edge 16*a* of the cam projection 16 by rotation of the time striking selecting cam plate 12, and rotates clockwise to release the pressure of the rocking lever 28 by the pin 24. Consequently, the rocking lever 28 rotates counter-clockwise, and the stopper 32 is engaged with the tooth corresponding to 2 o'clock among the rack teeth 34*a* of the rocking gear 34. At the same time, the pressing section 36 of the rocking lever 28 and the pin 26 of the rocking piece 14 release the pressed sustention of the both moving contact plates 10*a* and 10*b*. Accordingly, the moving contact plate 10*a* moves counter-clockwise from the position shown in FIG. 2, however, the moving contact plate 10*b* is engaged with the contact holder 58 of the switching control lever 52 to be kept in the position shown in the FIG. 3. Therefore, the closing circuit action of the electric contact means 10 is not performed in the FIG. 3, either.

In FIG. 4, shown therein is a state starting the time striking action at the right-hour, corresponding to the time of 2:00:00. In this state, the cam projection 50 of the time striking control cam plate 48 synchronously established with the controlled position of the second hand makes contact with the engaging portion 56 of the switching control lever 52, and moves the switching control lever 52 counter-clockwise. Consequently, the contact holder 58 of the switching control lever 52 is released from the moving contact plate 10*b* which returns to the contacting position with the moving contact plate 10*a* by its resilient property, and the closing circuit action of the electric contact means 10 is obtained.

Closing circuit of the electric contact means 10 rotates the driving motor in the electric time striking means to perform the time striking action. At this time, rotation of the driving cam 44 linked with the rotation of the electro-motor drives to move the rack teeth 34*a* of the rocking gear 34 once every striking action. Accordingly, after the completion of two time striking actions, the stopper 32 of the rocking lever 28 is released from the rocking gear 34 to return to the state shown in FIG. 1, which opens the both moving contact plates 10*a* and 10*b*. The time striking action is performed at every striking time with the numbers determined by the position of the rocking cam plate 40 corresponding to the indicated time. As described in the above, the present invention can provide the time striking action with extremely high accuracy since the electric contact means 10 is controlled in a state capable of closing circuit operation by the time striking control cam plate 48, and the time striking action can be performed at least within the range of ten seconds from the right-second of the second indicating hand.

Referring to FIG. 5, shown therein is a complete state of setting the second stage of the time striking action at the half-hour, corresponding to the time of 1:29:30. The state shown in FIG. 5 is almost same with the right-hour state in FIG. 2, but different in such point that the cam projection 18 of the time striking selecting cam plate 12 shows low in its height compared with the cam projection 16. Consequently, it is understood that the rotating distance of the rocking lever 28 moved by the rocking piece 14 is short. In other words, at the half hour, the stopper 32 of the rocking lever 28 does not release the rocking gear 34 completely, but releases the rocking gear 34 to the position where the stopper 32 is geared with the right end tooth of the rack teeth 34*a*. Accordingly, one striking action is always obtained in spite of the indicated time, and the striking action at the half-hour is performed.

The accuracy of time striking action in the present invention depends on the cam projection 50 of the time striking control cam plate 48, and the higher accuracy is obtained than the cam projection of the rocking cam plate in the prior art time striking device. It means that the time striking operation synchronized to the second hand as well as the minute hand is obtained and that the high accurate time striking device can be provided. In the present invention, moreover, there is the little affection to the time indicating gear train, since the time striking operation is performed with one or two second load in the time indicating gear train when striking the right-hour or the half-hour in relation to the engaging operation between the switching control lever 52 and the cam projection 50 of the time striking control cam plate 48. In the present invention, furthermore, the closing stroke in the closing circuit operation of the moving contact means 10 can be established so longer and the contacting pressure can be set so stronger than the prior art that the high stability of the switching operation is easily obtained.

In the composition other than the above mentioned embodiments, the modified embodiments of the present invention are described in the following:

1. The cam projection 50 of the time striking control cam plate 48 be formed into recesses.

2. The composition of elastic pressing of the switching control lever 52 toward the direction of arrow D be eliminated. It is required for the execution that the switching control lever 52 be formed to be inclined toward the time striking cam plate 48 by its own gravity.

3. An electronic sound be utilized for the time striking sound generating means. The time striking device be used only for taking the timing of time striking, and the rocking gear 34, the rocking lever 28, the driving cam 44, etc. could be eliminated. In this case, it is required to establish such composition that the rocking piece 14 moves to press the moving contact plates 10*a* and 10*b* to the working conditions.

4. The moving contact plate 10*a* be eliminated, and a microswitch, etc. be equipped in the corresponding position to the moving contact plate 10*b*.

Figure 7:
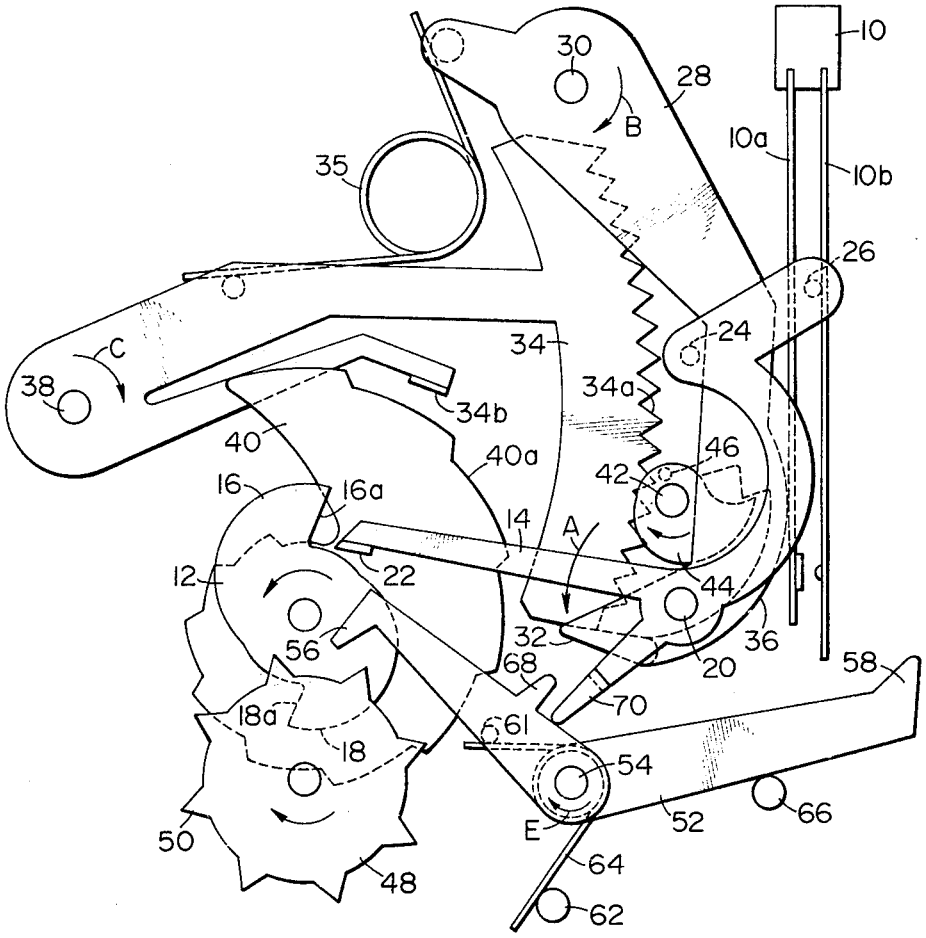
FIG. 7 is a top view of the time striking device in the second preferred embodiment in accordance with the teachings of the present invention.
Figure 8:
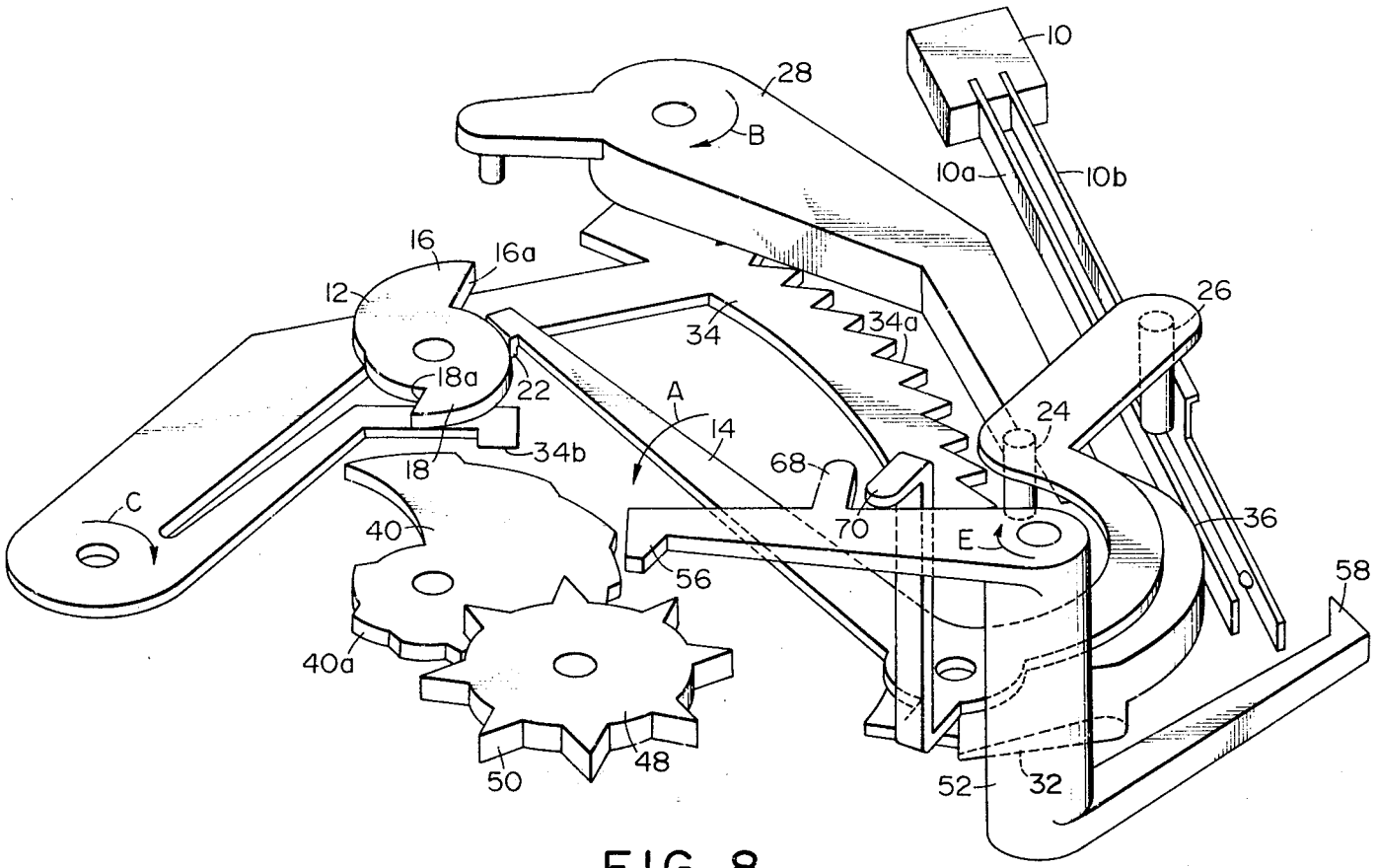
FIGS. 8 and 9 are perspective views of FIG. 7 from different direction.
Figure 9:
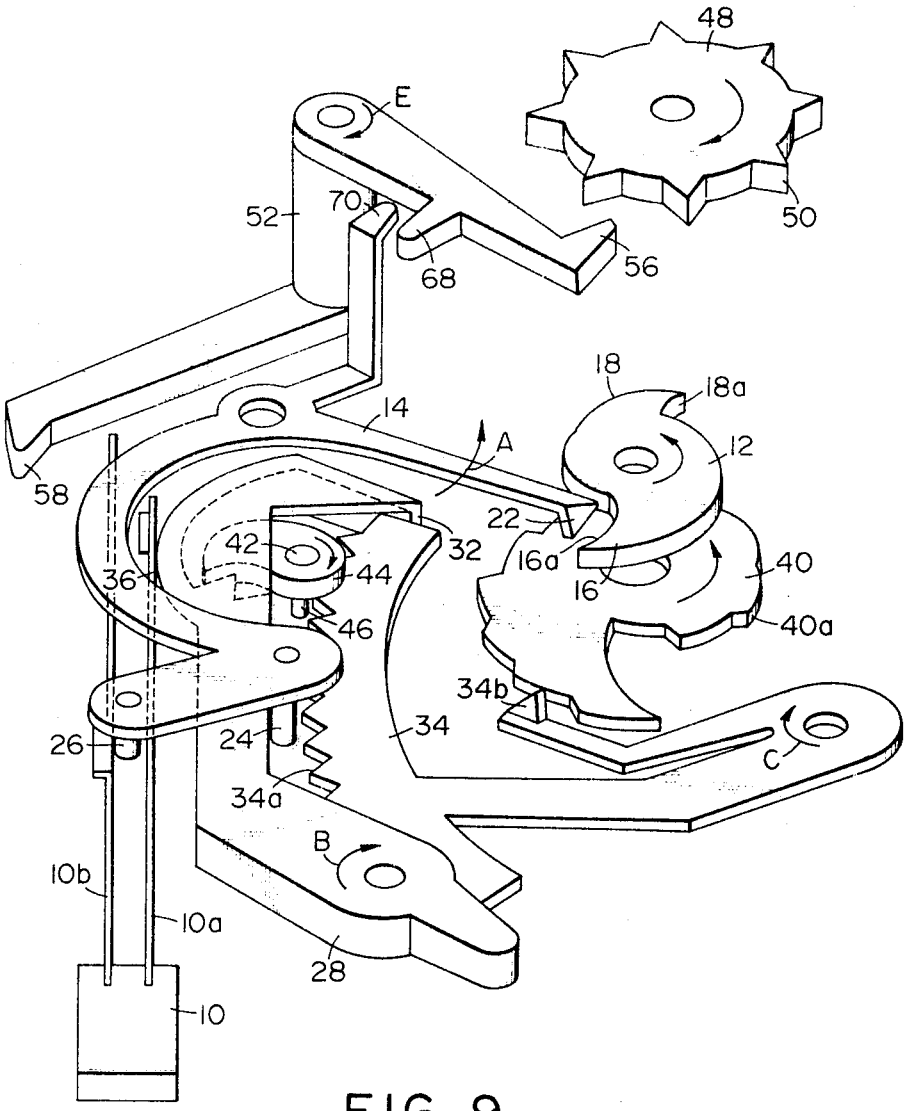

In FIG. 7, shown therein is the second preferred embodiment of the time striking device in accordance with the teachings of the present invention, and perspective views from different directions of FIG. 7 are shown in FIGS. 8 and 9.

Figure 10:
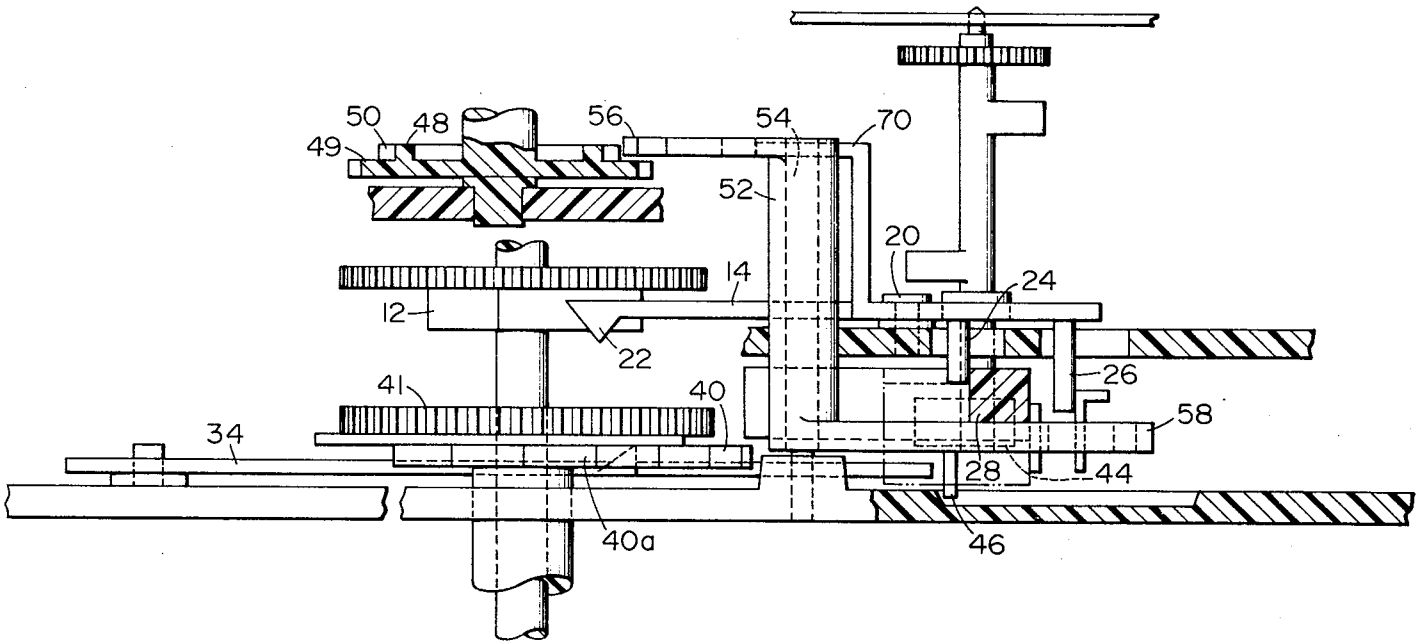
FIGS. 10 and 11 are sectional views of FIG. 7 broken away at respectively defferent positions.
Figure 11:
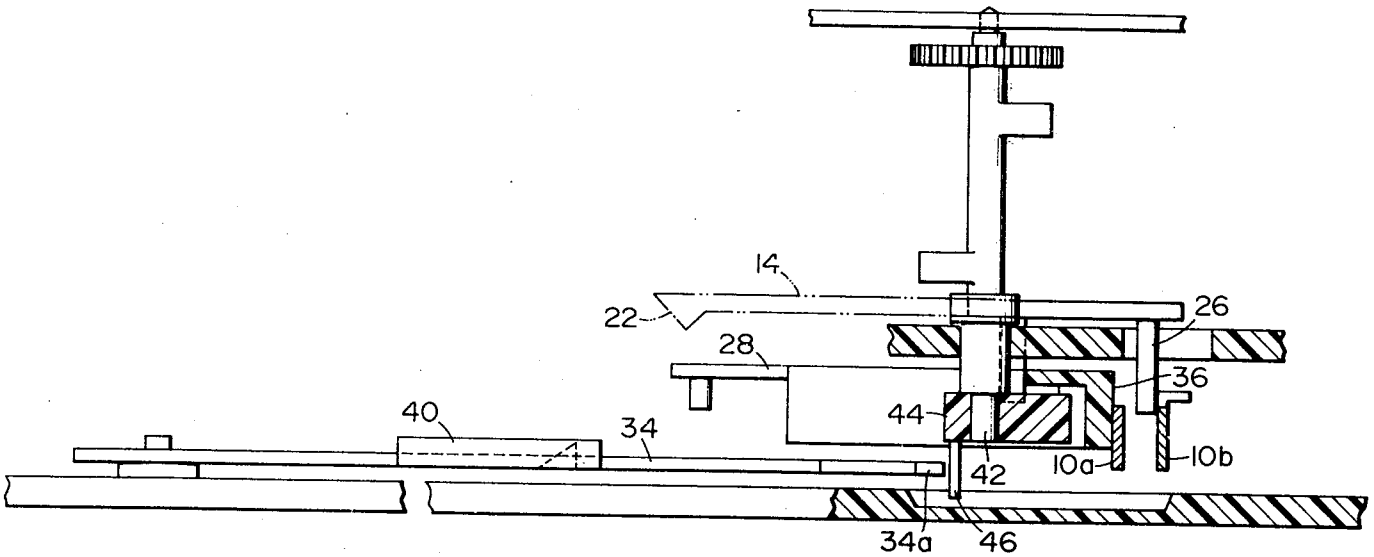

In FIGS. 10 and 11, shown therein are broken-away sectional views of FIG. 7.

Since the second embodiment is similar to the first embodiment in many respects, common elements in the second embodiment are given like numerals and an explanation of their interconnection and operation will be omitted.

In the second embodiment, the leading edge 16*a* and 18*a* of the both cam projections 16 and 18 are determined and placed so that they can set the striking time about ten seonds prior to the respective right-hour and half-hour. The rocking gear 34 is swingingly held by the pivot 38 which is fixed to the supporting plate, and always urged toward the direction of arrow C with elastic force by the spring 35. In this embodiment, the closing circuit operation of the electric contact means 10 is controlled by the time striking control cam plate 48 consisted in the one-minute cam plate which is separately installed from the time striking selecting cam plate 12 in order to obtain the highly accurate striking time. The one-minute cam plate 48 is solidly molded with the third wheel 49, as shown in FIG. 10, in order to synchronously rotate with the time indicating gear train, and is formed eight cam projections 50 around the circumference. Each cam projections 50 is composed to rotate one pitch per minute.

The switching control lever composed of one-minute control lever 52 which transmit the cam driving force of the one-minute cam plate 48 to the electric contact means 10 is always urged toward the direction of arrow E by the spring 64 lying between the pin 61 stood on the one-minute control lever 52 and a fixed pin 62, and is resiliently sustained in the position to be engaged with the pin 66 which is fixed to the supporting plate.

As evident from FIG. 7, it is understood that, in the state that the one-minute control lever 52 is engaged with the pin 66, the engaging portion 56 stays out of the rotation area of the time striking control cam plate 48. The projection arm 68 is formed with the one-minute control lever 52, and the extended arm 70 of the rocking piece 14 is engageably formed to face the projection arm 68.

The second preferred embodiment of the present invention is composed as mentioned in the above, and the operation of the second preferred embodiment of the present invention is described in the following, referring to FIG. 7, and FIGS. 12, 13 and 14 which show various stages.

In FIG. 7, shown therein is a completed operating state of the time striking action at the right-hour, for example, it corresponds to the time about 2:05. In this state, the cam follower 22 of the rocking piece 14 faces to the alcove portion of the time striking selecting cam plate 12, and the stopper 32 of the rocking lever 28 stays in the illustrated position to be engaged with the left end portion of the rack teeth 34*a* of the rocking gear 34. The both moving contact plates 10*a* and 10*b* are sustained in the portion by the respective pressing section 36 of the rocking lever 28 and the pin 26 of the rocking piece 14, and the electric contact means 10 is in the open circuit state. The time striking means is kept in non-operational state accordingly.

In FIG. 7, as mentioned in the above, the engaging portion 56 stays out of the rotating area of the time striking control cam plate 48, since the one-minute control lever 52 is urged by the spring 64 to the engaging portion with the pin 66. Consequently, in the ordinary cases excluding the striking time, the time striking control cam plate 48 is simply run idle and there is no load produced to the time indicating gear train by the one-minute control lever 52.

Figure 12:
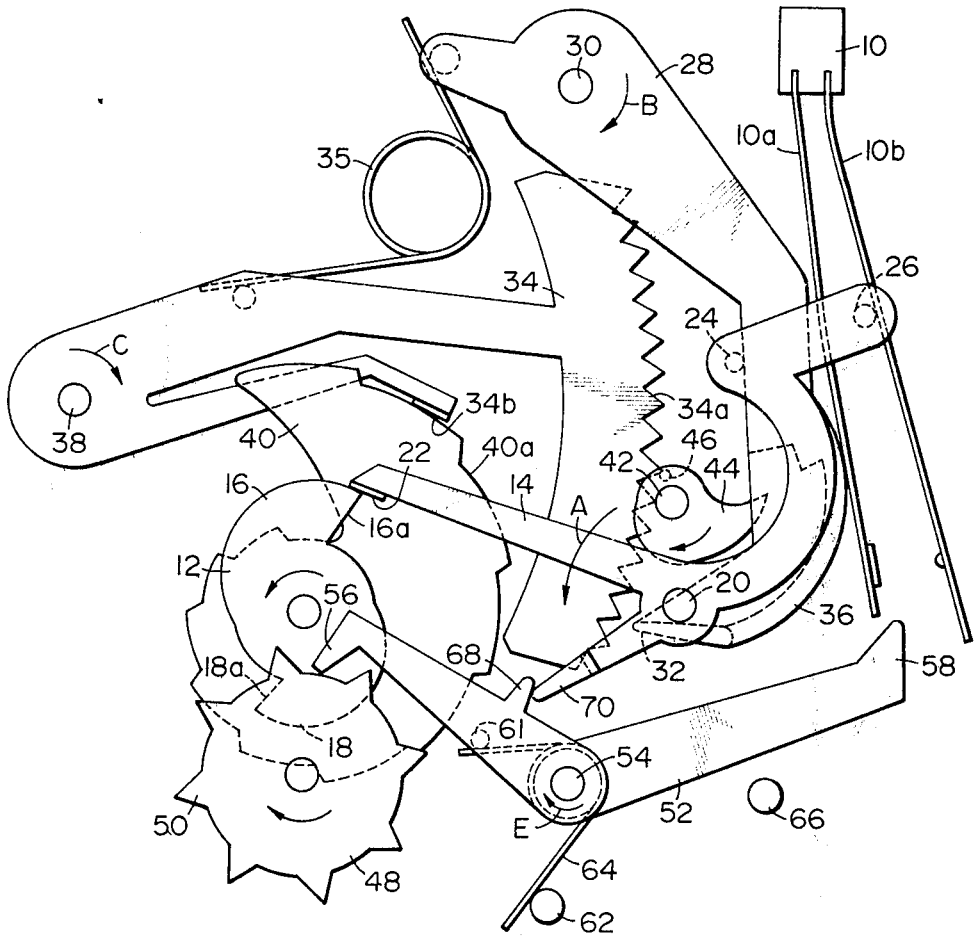
FIGS. 12, 13, 14 and 15 are top views showing the respective operating conditions of FIG. 7.

In FIG. 12, shown therein is a completed state of setting the first stage of the time striking action at the right-hour and a state of the time about 1:59:30. In this state, the rocking piece 14 is rotated clockwise by the cam projection 16 of the time striking selecting cam plate 12, and the rocking lever 28 is rotated counterclockwise to move to the position where the stopper 32 can be released from the rocking gear 34. Consequently, the rocking gear 34 rotates clockwise to the position where the cam follower 34*b* makes contact with the cam surface 40*a* of the rocking cam plate 40 corresponding to 2 o'clock. In this state, the both moving contact plates 10*a* and 10*b* of the electric contact means 10 are respectively pressed to move to the illustrated position by the pressing section 36 of the rocking lever 28 and the pin 26 of the rocking piece 14, and the electric contact means 10 is still kept in the open circuit state.

Furthermore, the rocking piece 14 presses to rotate the projection arm 68 of the one-minute control lever 52 by its extended arm 70 so that the one-minute control lever 52 rotates counter-clockwise against the force of the spring 64, and the engaging portion 56 falls into the rotating area of the time striking control cam plate 48. The action of the contact holder 58 at this time is established in the various composition so that the contact holder 58 cannot collide with the moving contact plate 10*b*.

Figure 13:
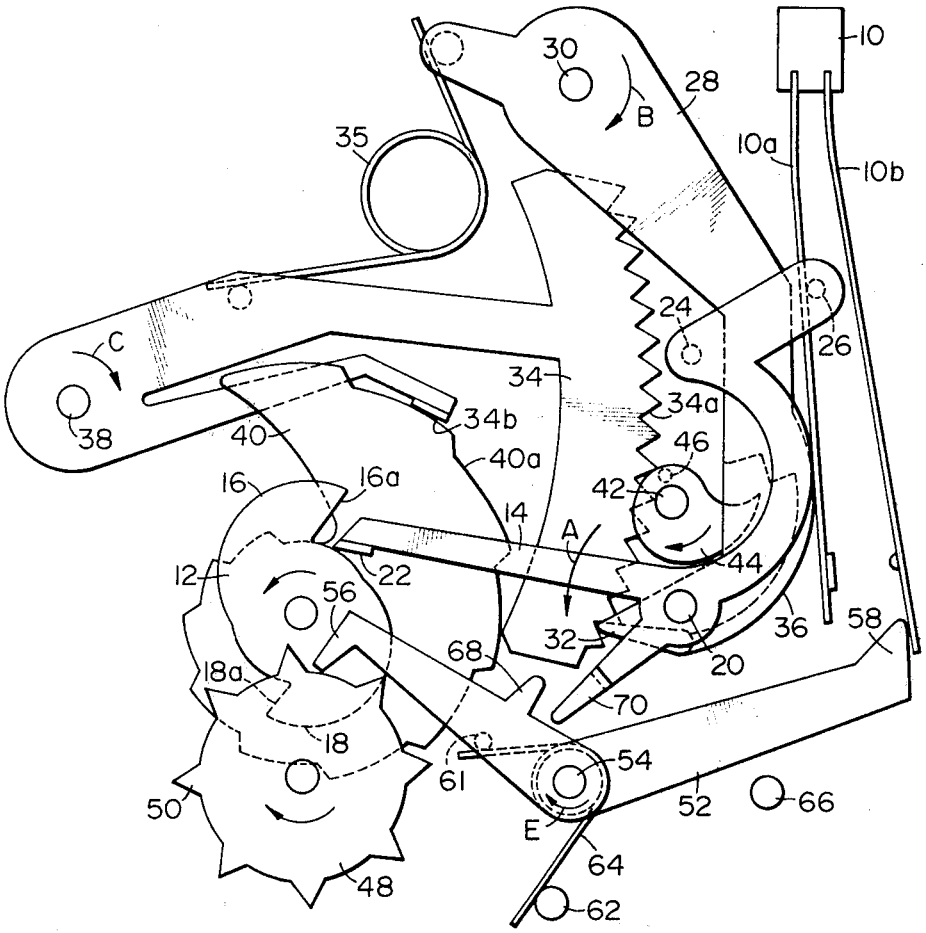

In FIG. 13, shown therein is a complete state of setting the second stage of the time striking action at the right-hour, which corresponds to the time of 1:59:50. In this state, the rocking piece 14 moves to fall into the leading edge 16*a* of the cam projection 16 by the rotation of the time striking selecting cam plate 12, and rotates counter-clockwise to release the pressure of the rocking lever 28 by the pin 24. Consequently, the rocking lever 28 rotates clockwise, and the stopper 32 is engaged with the tooth corresponding to 2 o'clock among the rack teeth 34*a* of the rocking gear 34. At the same time, the pressing section 36 of the rocking lever 28 and the pin 26 of the rocking piece 14 release the pressed sustention of the both moving contact plates 10*a* and 10*b*. Accordingly, the moving contact plate 10*a* moves clockwise from the position shown in FIG. 12, however, the moving contact plate 10*b*is engaged with the contact holder 58 of the switching control lever 52 to be kept in the position shown in FIG. 13. Therefore, the closing circuit action of the electric contact means 10 is not performed in FIG. 13, either.

In the operation mentioned in the above, the counter-clockwise rotation of the rocking piece 14 also releases the engagement between the extended arm 70 and the projection arm 68, and the clockwise rotating force by the spring 64 is activated to the switching control lever 52. The switching control lever 52 is, however, kept in the position shown in FIG. 13 by the moving contact plate 10*b* since the rotating force by the moving contact plate 10*b* is established to exist in equilibrium with the rotating force by the spring 64.

Figure 14:
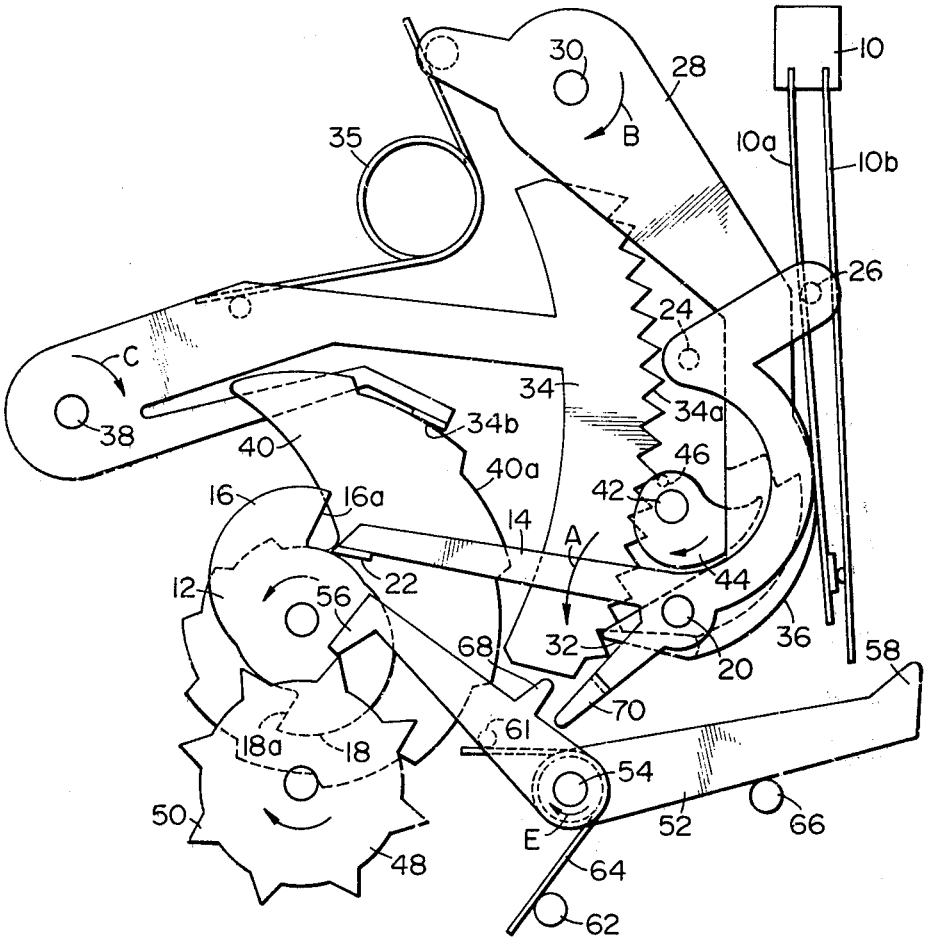

Referring to FIG. 14, shown therein is a state starting the time striking action at the right-hour, corresponding to the time of 2:00:00. In this state, the cam projection 50 of the time striking control cam plate 48 synchronously established at the controlled position of the second hand makes contact with the engaging portion 56 of the switching control lever 52, and moves the switching control lever 52 clockwise. Consequently, the contact holder 58 of the switching control lever 52 is released from the moving contact plate 10*b*, which returns to the contacting position with the moving contact plate 10*a* by its resilient property, and the closing circuit action of the electric contact means 10 is obtained.

Closing circuit of the electric contact means 10 rotates the driving motor in the electric time striking means to perform the time striking action. At this time, the rotation of the driving cam 44 linked with the rotation of the electro-motor drives to move the rack teeth 34*a* of the rocking gear 34 once every striking action. Accordingly, after the completion of two time striking actions, the stopper 32 of the rocking lever 28 is released from the rocking gear 34 to return to the state shown in FIG. 7, which opens the both moving contact plate 10*a* and 10*b*. The time striking action is performed at every striking time with the members determined by the position of the rocking cam plate 40 corresponding to the indicated time.

As mentioned in the above, the embodiment of present invention can provide the time striking action with extremely high accuracy since the electric contact means 10 is controllec in a state capable of closing circuit operation by the time striking control cam plate 48, and the time striking action can be performed at least within the range of ten seconds from the right-second of the second indicating hand.

Figure 15:
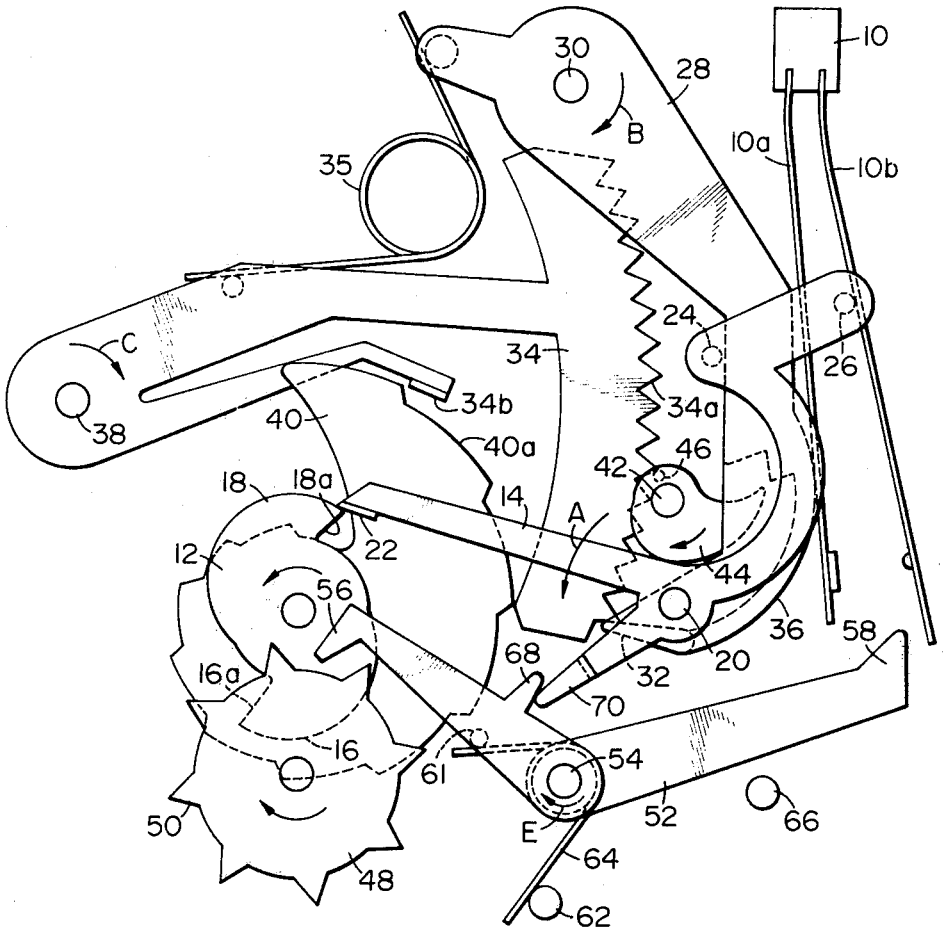

In FIG. 15, shown therein is a complete state of setting the second stage of the time striking action at the half-hour, corresponding to the time of 1:29:30. The state shown in FIG. 15 is almost same with the right-hour state in FIG. 12, but different in such point that the cam projection 18 of the time striking selecting cam plate 12 shows low in its height compared with the cam projection 16. Consequently, it is understood that the rotating distance of the rocking lever 28 moved by the rocking piece 14 is short. In other words, at the half-hour, the stopper 32 of the rocking lever 28 does not release the rocking gear 34 completely, but releases the rocking gear 34 to the position where the stopper 32 is geared with the lower end tooth of the rack teeth 34*a*. Accordingly, one striking action is always obtained in spite of the indicated time, and the striking action at the half-hour is performed.

As evident from the afore-mentioned, the present invention can provide the time striking action with extremely high accuracy and have such advantage that the switching control lever is engaged with the time striking control cam plate in striking time only, and that there is no loading loss affected to the time indicating gear train in the other regular hours.

In the embodiment, incidentally, the switching control lever is controlled by the rocking piece, but it is possible to be directly controlled by the time striking selecting cam plate to be indirectly controlled through the other intermediate element.

In FIG. 16 through 21, shown therein is the third preferred embodiment of the time striking device in accordance with the teachings of the present invention. Since the third embodiment is similar to the second embodiment in many respects, common elements in the third embodiment are given like numerals and an explanation of their interconnection and operation will be omitted.

In the third embodiment, there are eight slots 72 formed in the vicinity of the cam projections 50 of the time striking control cam plate 48 to form positioning mark for the assembly of the timepiece. In the embodiment, there is a zero-second reset mechanism installed in the time indicating gear train, and, in Figures, the second hand wheel to which the second indicating hand is fixed has a second heart cam 74 drawn in the chain line, and there is a slot 76 which forms the positioning mark made through the heart cam 74. Accordingly, in the assembling of the timepiece, the fitting of the slots 72 of the above mentioned time striking control cam plate 48 and the slot 76 of the second heart cam 74 makes it possible to coincide the closing circuit action of the electric contact means 10 with the indicating position of the second indicating hand.

The third preferred embodiment of the present invention is composed as mentioned in the above, and the operation is described in the following.

Figure 16:
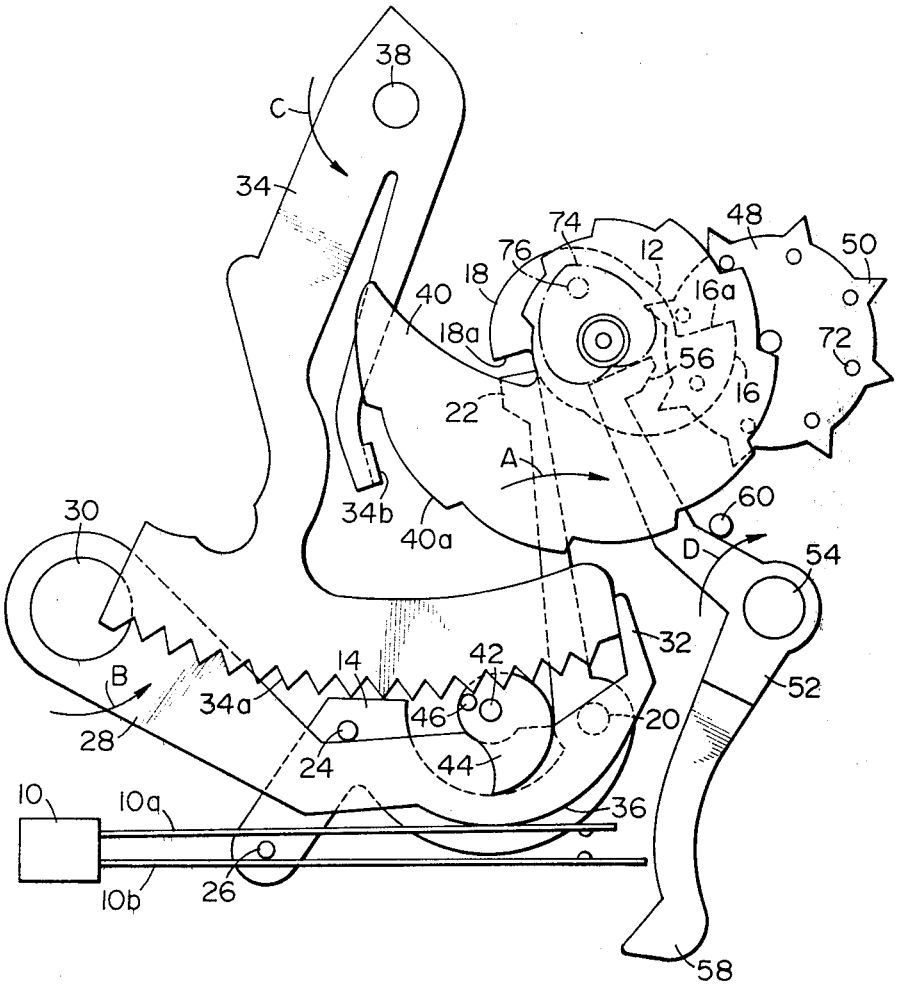

In FIG. 16, shown therein is a time before the striking action is performed at the right-hour and an operating state after the striking action is finished at the half-hour, for example, it corresponds to the time about 1:35. In this state, the cam follower 22 of the rocking piece 14 is engaged with the alcove portion of the time striking selecting cam plate 12, and the stopper 32 of the rocking lever 28 stays in the position to be engaged with the right end of the rack teeth 34*a* of the rocking gear 34 as illustrated. The both moving contact plates 10*a* and 10*b* are respectively sustained in the position by the pressing section 36 of the rocking lever 28 and the pin 26 of the rocking piece 14, and the electric contact means 10 is in the open circuit state. The time striking means is kept in non-operational state accordingly.

Figure 17:
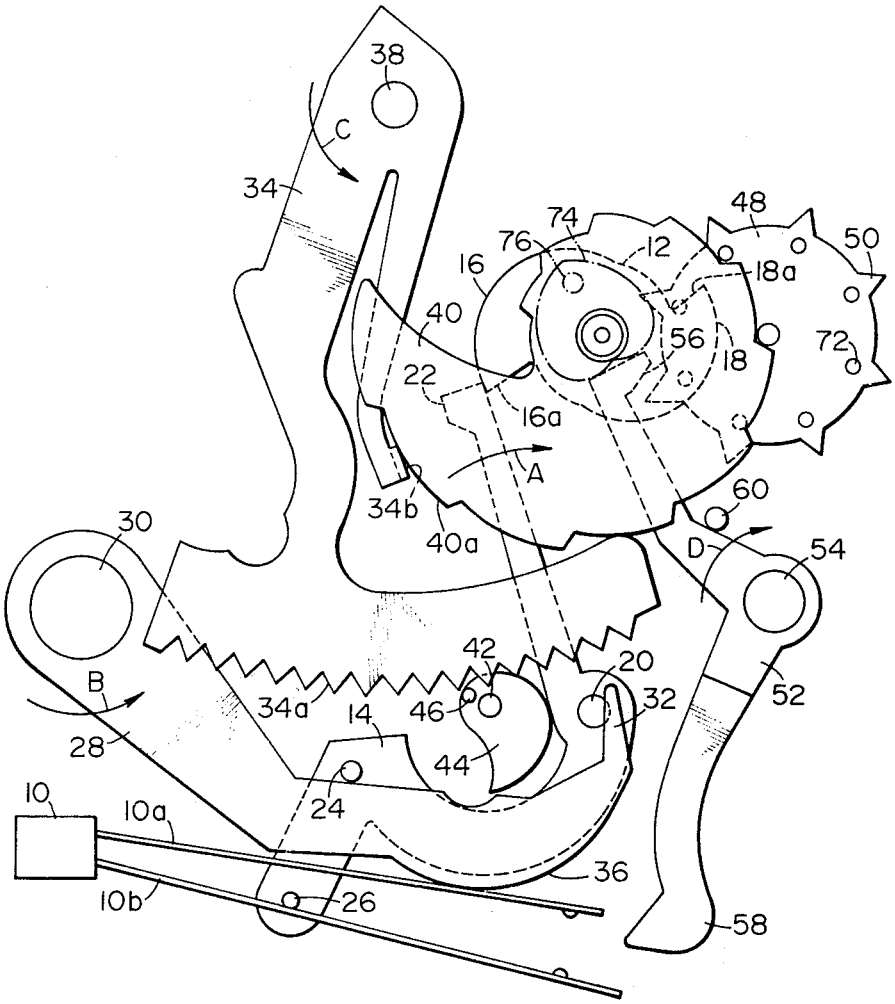

Referring to FIG. 17, shown therein is a complete state of setting the first stage of the time striking action at the right-hour, and a state of the time about 1:50 after the time striking selecting cam plate 12 rotates clockwise from the FIG. 16 conditions. In this state, the rocking piece 14 is rotated counter-clockwise by the cam projection 16 of the time striking selecting cam plate 12, and the rocking lever 28 is rotated clockwise to move to the position where the stopper 32 can be released from the rocking gear 34. Consequently, the rocking gear 34 rotates counter-clockwise to the position where the concerned cam follower 34*b* makes contact with the cam surface 40*a* of the rocking came plate 40 corresponding to 2 o'clock. In this state, the both moving contact plates 10*a* and 10*b* are respectively pressed to move to the illustrated position by the pressing section 36 of the rocking lever 28 and the pin 26 of the rocking piece 14, and the electric contact means 10 is still kept in the open circuit state.

In the operational state from FIG. 16 to FIG. 17, each cam projection 50 of the time striking control cam plate 48 is engaged with the engaging portion 56 of the switching control lever 52 at every one minute to swingingly control the switching control lever 52. In this state, the contact holder 58 of the switching control lever 52 happens to be temporarily engaged with the moving contact plate 10*b*, but the closing circuit action of the electric contact means is not performed since the moving contact plate 10*b* is controlled its position by the pin 26 of the rocking piece 14.

Figure 18:
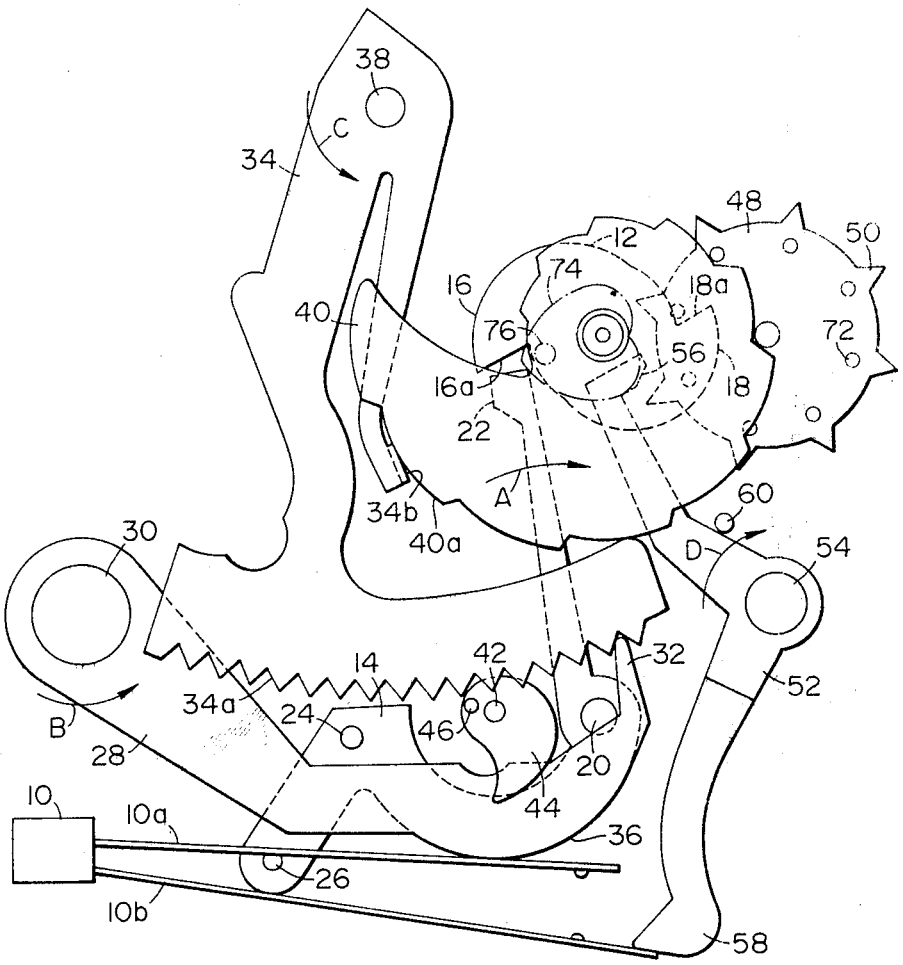

In FIG. 18, shown therein is a completed state of setting the second stage of the time striking action at the right-hour, which corresponds to the time of 1:59:30. In the state, the cam follower 22 of the rocking piece 14 moves to fall into the leading edge 16*a* of the cam projection 16 by rotation of the time striking selecting cam plate 12, and rotates clockwise to release the pressure of the rocking lever 28 by the pin 24. Consequently, the rocking lever 28 rotates counter-clockwise, and the stopper 32 is engaged with the tooth corresponding to 2 o'clock among the rack teeth 34*a* of the rocking gear 34. At the same time, the pressing section 36 of the rocking lever 28 and the pin 26 of the rocking piece 14 release the pressed sustention of the both moving contact plates 10*a* and 10*b*. Accordingly, the moving contact plate 10*a* moves counter-clockwise from the position shown in FIG. 17, however, the moving contact plate 10*b* is engaged with the contact holder 58 of the switching control lever 52 to be kept in the position shown in FIG. 18. Therefore, the closing circuit action of the electric contact means 10 is not performed in FIG. 18, either.

In FIG. 19, shown therein is a state starting the time striking action at the right-hour, corresponding to the time of 2:00:00. In this state, the cam projection 50 of the time striking control cam plate 48 synchronously established at the controlled position of the second hand makes contact with the engaging portion 56 of the switching control lever 52, and moves the switching control lever 52 counter-clockwise. Consequently, the contact holder 58 of the switching control lever 52 is released from the moving contact plate 10*b*, which returns to the contacting position with the moving contact plate 10*a* by its resilient property, and the closing circuit action of the electric contact means 10 is obtained.

Closing circuit of the electric contact means 10 rotates the driving motor in the electric time striking means to perform the time striking action. At this time, rotation of the driving cam 44 linked with the rotation of the electro-motor drives to move the rack teeth 34*a* of the rocking gear 34 once every striking action. Accordingly, after the completion of two time striking actions, the stopper 32 of the rocking lever 28 is released from the rocking gear 34 to return to the state shown in FIG. 16, which opens the both moving contact plates 10*a* and 10*b*. The time striking action is performed at every striking time with the numbers determined by the position of the rocking cam plate 40 corresponding to the indicated time. As described in the above, the present invention can provide the time striking action with extremely high accuracy since the electric contact means 10 is controlled in a state capable of closing circuit operation by the time striking control cam plate 48, and the time striking action can be performed at least within the range of ten seconds from the right-second of the second indicating hand.

Referring to FIG. 20, shown therein is a completed state of setting the second stage of the time striking action at the half-hour, corresponding to the time of 1:29:30. The state shown in FIG. 20 is almost same with the right-hour state in FIG. 17, but different in such point that the cam projection 18 of the time striking selecting cam plate 12 shows low in its height compared with the cam projection 16. Consequently, it is understood that the rotating distance of the rocking lever 28 moved by the rocking piece 14 is short. In other words, at the half hour, the stopper 32 of the rocking lever 28 does not release the rocking gear 34 completely, but releases the rocking gear 34 to the position where the stopper 32 is geared with the right end tooth of the rack teeth 34*a*. Accordingly, one striking action is always obtained in spite of the indicated time, and the striking action at the half-hour is performed.

As is evident from the above-mentioned embodiment, the present invention can provide the time striking action with extremely high accuracy. It is, however, required that the striking time established by the time striking control cam plate 48 is precisely coincided with the position of the second indicating hand in order to obtain the time striking action with high accuracy. In order to have the coincidence of the striking time and the position of the second indicating hand, used for the positioning mark as described hereinbefore are the slots 72 and 76 formed with both the time striking control cam plate 48 and the second heart cam 74. In other words, the coincidence of the striking time and the position of the second indicating hand is performed by the precise overlap of the slot 76 of the second heart cam 74 and the slot 72 of the time striking control cam plate 48 in such state that the second heart cam is corrected to be set at zero second conditions by the zero-second resetting lever in assembling the timepiece. This overlapping operation can be accomplished by the eye sight assembly or the insertion of a jig such as tweezers, etc.

Referring further to the FIG. 21, shown therein is the composition for easy positioning of the time striking control cam plate 48 and the second indicating hand in the assembly of the timepiece. In FIG. 21, a supporting plate 78 also has the positioning mark consisting in a slot 80. The coincidence and positioning at respective places are easily obtained by the engagement of the slot 80 of the supporting plate 78 with the jig pin 84 of an assembling jig 82, and the further engagement of the slot 72 of the time striking control cam plate 48 and the slot 76 of the second heart cam 74 with the jig pin 84. In FIG. 21, the time striking control cam plate 48 is solidly molded with the third wheel 49 and the second heart cam 74 is fixed to a second hand shaft 86. In the positioning state in FIG. 21, the second indicating wheel shows the right-second, and a zero-second resetting lever 88 is in the state setting the second heart cam 74 at zero second. Furthermore, the positioning state in FIG. 21 shows the state starting the striking action in FIG. 19, and the contact holder 58 of the switching control lever 52 is in the state releasing the engagement of the moving contact plate **10*b*. In the state of FIG. 19, it can provide extremely accurate time striking positioning that the fixed location of the electric contact means 10 is decided for the moving contact plate 10*b* to be easily released from the contact holder 58 in the assembly of the timepiece. The fixed location of the electric contact means 10** can be adjusted by the fixing screws, and for the fine adjustment eccentric screws, etc. could be used.

As mentioned heretofore in the embodiment, the time striking accuracy depends on the time striking control cam plate which rotates in comparatively high speed, and is remarkably increased when compared with the prior art device. In the embodiment, furthermore, the striking time is easily adjusted with the coincidence and positioning of the time striking control cam plate and the zero second heart cam, and the late time striking phenomenon, etc. can be firmly eliminated.

In all cases it is understood that the above described embodiments are merely illustrative of but a few of the many possible specific embodiments which represent the applications of the principles of the present invention. Numerous and varied other arrangements can be readily devised by those skilled in the art without departing from the spirit and scope of the invention.

I claim:

1. A time striking device for a timepiece comprising:

an electric time striking means;

an electric contact means electrically controlling the operation of said time striking means;

a time striking selecting cam plate synchronously rotating with a time indicating gear train to control said electric contact means in a state capable of closing circuit action at the striking time;

a time striking control cam plate synchronously rotating with the time indicating gear train to control said electric contact means in a state capable of closing circuit action at shorter interval than said time striking selecting cam plate;

a switching control lever, one end of which is engaged with said time striking control cam plate and the other end of which is engaged with an end portion of a moving contact plate of said electric contact means, to control switching on and off action of said electric contact means; and a closing circuit action of said electric contact means in a state capable of closing circuit action by said time striking selecting cam plate and said time striking control cam plate performing a time striking operation of said electric time striking means.

2. A time striking device for a timepiece according to claim 1 wherein said time striking control cam plate is composed of a one-minute cam plate which controls said electric contact means in a state capable of closing circuit action at one minute interval.

3. A time striking device for a timepiece comprising:

an electric time striking means;

an electric contact means electrically controlling the operation of said time striking means;

a time striking selecting cam plate synchronously rotating with a time indicating gear train to control said electric contract means in a state capable of closing circuit action at a striking time;

a one-minute cam plate synchronously rotating with the time indicating gear train to control said electric contact means in a state capable of closing circuit action at one minute interval;

a one-minute control lever transmitting contact point control force of said one-minute cam plate to a moving contact plate of said electric contact means;

a time striking operation of said electric time striking means being performed by the closing circuit action of said electric contact means in a state capable of closing circuit action by said time striking selecting cam plate and said one-minute cam plate; and said one-minute control lever being rotated to a position wherein said one-minute control lever cannot be engaged by said one-minute cam plate rotation while it is not in a striking time so that said one-minute cam plate can run idle.

4. A time striking device for a timepiece according to claim 3 wherein said one-minute control lever is controlled to rotate to a position wherein said one-minute control lever can be engaged by said one-minute cam plate rotation by said time striking selecting cam plate.

5. A time striking device for a timepiece according to claim 3 wherein a controlling force of said time striking selecting cam plate is transmitted to said one-minute control lever through a rocking piece.

* * * * *